US005484388A

United States Patent [19]

Bassett et al.

[11] Patent Number: 5,484,388

[45] Date of Patent: Jan. 16, 1996

[54] METHOD AND DEVICE FOR TREATING BONE DISORDERS BY APPLYING PRELOAD AND REPETITIVE IMPACTS

[75] Inventors: C. Andrew L. Bassett, Bronxville, N.Y.; Govert L. Bassett, Charlotte, N.C.

[73] Assignee: Osteo-Dyne, Inc., Morrisville, N.C.

[21] Appl. No.: 85,300

[22] Filed: Jul. 2, 1993

[51] Int. Cl.[6] ..... A63B 21/00

[52] U.S. Cl. ..... 601/27; 601/33; 601/51; 601/100

[58] Field of Search ..... 601/24, 26, 27, 601/29, 30, 33, 46, 48, 51, 61, 62, 65, 66, 78, 79, 84, 97, 98, 100, 107, 108; 128/897–898

[56] References Cited

U.S. PATENT DOCUMENTS

| | | | |
|---|---|---|---|
| 4,928,959 | 5/1990 | Bassett et al. | 601/27 |
| 5,046,484 | 10/1991 | Bassett et al. | 601/24 |
| 5,191,880 | 3/1993 | McLeod et al. | 601/2 |
| 5,273,028 | 12/1993 | McLeod et al. | 601/35 |

OTHER PUBLICATIONS

Bassett, "Effect of Force on Skeletal Tissues," Physiological Basis of Rehabilitation Medicine, Downey and Darling eds., 1st ed., 1971, Ch. 16.

Rubin et al., "regulation of Bone Formation by Applied Dynamic Loads," The Journal of Bone and Joint Surgery, 66–A(3): 397–492(Mar. 1984).

Bourrin et al., Bone Mass and Bone Cellular Variations After Five Months of Physical Training in Rhesus Monkeys: Histomorphometric Study, 1992, pp. 50:404–410.

Chow et al., Effect of Two Randomised Exercise Programmes on Bone Mass of Healthy Postmenopausal Women, Dec. 5, 1987, pp. 1441–1443.

Forwood et al., Repetitive Loading, In Vivo of the Tibia and Femora of Rats Effects of a Single Bout of Treadmill Running, 1992, pp. 50:193–196.

Hagino et al., Effect of Overiectomy on Bone Response to In Vivo External Loading, 1993, pp. 347–357.

Henderson et al., In–Vivo Evidence of Increased Osteocyte Activity Induced by Physical Exercise, 1993, 75–B.

McLeod et al., Low Frequency Resonances Recorded In–Vivo Functionally Loaded Bone, p. 888.

Leichter et al., Gain in Mass Density of Bone Following Strenuous Physical Activity, 1989, pp. 86–90.

Keller et al., Regulation of Bone Stress and Strain in the Immature Rat Femur, abstract, p. 888.

Gray et al., Distribution of Strain Magnitude in the Cannon Bone of the Horse, abstract, p. 888.

Hert et al., Structure, Growth and Loading of the Sheep Tibia, abstract, p. S32.

AvFavia et al., Bone Tissue Accretion in Bones Loaded In Vitro, abstract, p. S32.

Muller–Mai et al., The Reaction of Bone to Mechanical Load, abstract, p. S32.

Salvesen et al., Different Responses to Exercise on Biomarkers in Well–Trained Man and Women, abstract, p. S32.

Margulies et al., Effect of Intense Physical Activity on the Bone–Mineral Content in the Lower Limbs of Young Adults, 1986, pp. 1090–1093.

Newhall et al., Effects of Voluntary Exercise on Bone Mineral Content in Rats, 1991, pp. 289–296.

(List continued on next page.)

*Primary Examiner*—Angela D. Sykes
*Assistant Examiner*—John P. Lacyk
*Attorney, Agent, or Firm*—Finnegan, Henderson, Farabow, Garrett & Dunner

[57] ABSTRACT

Bone disorders may be treated by applying a compressive preload and repetitive impacts. The patient may be maintained in a static position and the preload be provided by gravity or compression. The impact load, impact rate, and a number of impacts determined by a physician prior to treatment are chosen to generate electrical signals in the patient's bone such that the majority of energy of the electrical signals lies between 0.1 Hz and 1 kHz, and the peak amplitude values of the electrical signals lie between 15 and 30 Hz.

21 Claims, 4 Drawing Sheets

OTHER PUBLICATIONS

Raab et al., A Histomorphometric Study of Cortical Bone Activity During Increased Weight–Bearing Exercise, 1991, pp. 741–749.

Recker et al., Periosteal Bone Formation After In Vivo Mechanical Loading in Rats, 1991, p. 8.

Salem et al., Adaptions of Immature Trabecular Bone to Moderate Exercise: Geometrical, Biochemical, and Biomechanical Correlates, 1993, pp. 647–654.

Shaw et al., Mechanical, Morphological and Biomechanical Adaptions of Bone and Muscle to Handlings Suspension and Exercise, 1987, pp. 225–234.

White et al., Effects of Exercise on Postmenopausal Osteoporosis, 1982, p. 106.

Tuukkanen et al., Effect of Exercise on Osteoporosis Induced by Ovariectomy in Rats, 1991, p. S80.

Lanyon, The Success and Failure of the Adaptive Response to Functional Load–bearing in Averting Bone Fracture, 1992, p. S17–S21.

METHOD AND DEVICE FOR TREATING BONE DISORDERS BY APPLYING PRELOAD AND REPETITIVE IMPACTS

BACKGROUND OF THE INVENTION

The present invention relates generally to the treatment of osteoporosis and afflictions characterized by inadequate local or general bone mass, and specifically the use of impact loading of bone under a gravitational or mechanically-induced preload.

Osteoporosis is a pernicious disorder usually, but not exclusively, afflicting elderly women. The osteoporotic state can also be manifest by those who are confined to bed and even by astronauts who are in a weightless environment. Osteoporosis occurs through a decrease in bone mass which makes the afflicted bones more fragile and more susceptible to breaking.

The fractures resulting from osteoporosis can cause death, require extended hospital stays, and sometimes involve expensive and painful surgery. Health care costs for this condition approach ten billion dollars per year in the U.S. alone. In addition, osteoporosis severely diminishes the mobility and vitality of those affected with the disease.

The general population also feels the effects of this disease. Persons afflicted with osteoporosis must depend upon relatives and others for care, and everyone is affected by the health care costs and the use of hospital or nursing home facilities attributable to this affliction.

The reduction in bone mass from osteoporosis results when bone destruction outpaces bone formation. The balance between destruction and formation is affected by hormones, calcium intake, vitamin D and its metabolites, weight, smoking, alcohol consumption, exercise and many other factors too numerous to catalogue here.

To slow or reverse bone loss, doctors have focused their attention on estrogens, calcium, and exercise, used either together or individually. More recently, fluorides and thiazides have been tested as therapeutic agents, but none of these approaches has been successful in restoring a severely depleted skeletal bone mass to normal. In addition, many elderly individuals with advanced bone loss cannot participate in exercise programs due to poor reflexes, motor tone and balance, as well as stress pain and stress fractures.

Certain researchers have suggested an electrical intermediary in Wolff's law. Wolff's law states, in short, that bone adapts to the forces acting upon it. In other words, bone will increase in mass and remodel to relieve the applied stress.

Because bone is piezoelectric and electrokinetic, it generates an electrical signal in response to the applied force. That electrical signal then effects bone formation. This is explained in Bassett, "Effect of Force on Skeletal Tissues," Physiological Basis of Rehabilitation Medicine, Downey and Darling eds., 1st ed., W. B. Saunders Co. (1971). On the basis of Wolff's law and more recent investigations, two techniques have been developed for treatment of bone disorders. One involves mechanical forces and the other involves electrical forces.

One of the first and most complete investigations into the effect of mechanical loading on bone tissue was reported in Cochran et al., "Electromechanical Characteristics of Bone Under Physiologic Moisture Conditions," Clinical Orthopaedics 58: 249–270 (1968). In that article, both in vitro and in vivo measurements showed the electrical potentials developed due to bone deformation. The results of this and related work led to the use of electromagnetic stimulation to control bone tissue as reported in Bassett et al., "Augmentation of Bone Repair by inductively Coupled Electromagnetic Fields," Science, 184:575–77 (1974), and Bassett et al., "A Non-Operative Salvage of Surgically Resistant Pseudarthroses, and Non-Unions by Pulsing Electromagnetic Fields, A Preliminary Report," Clinical Orthopaedics, 184:128–143 (1977). Such work and research also led to the development of products for the stimulation of bone tissue electromagnetically. In addition, some work was carried over into the treatment of osteoporosis, as reported in Bassett et al., "Prevention of Disuse Osteoporosis in the Rat by Means of Pulsing Electromagnetic Fields," (in Brighton et al., *Electrical Properties of Bone and Cartilage: Experimental Effects and Clinical Applications,* 311–33, 1979); Cruess et al., "The Effect of Pulsing Electromagnetic Fields on Bone Metabolism in Experimental Disuse Osteoporosis," Clinical Orthopaedics, 173: 245–250 (1983); and Rubin et al., "Prevention of Osteoporosis by Pulsed Electromagnetic Fields: An in vivo animal model identifying an osteogenic power window," J. Bone Joint Surgery, 71A: 411–17, 1989.

The Cochran paper also suggested the possibility of a critical mechanical loading rate to generate maximal voltages. To this end, patients have been treated with axial compression exercises, as reported in Bassett '71, on pages 312–314. In general, however, this work has received less attention than the electromagnetic work.

Some interest in mechanical methods of controlling bone loss has continued. For example, the National Aeronautic and Space Administration funded a study whose purpose was to use impact loading on patients' heels to stimulate bone formation. Reference to this work was described in an abstract printed in the U.S.P.H.S. Professional Association, 11th Annual Meeting (May 26–29, 1976), and entitled "Modification of Negative Calcium Balance and Bone Mineral Loss During Bed Rest: Impact Loading." The abstract reported that impact loading, which was kept to 25 pounds, could slow down the loss of calcium and achieve other beneficial results.

More recently, two papers by Rubin and Lanyon have suggested that periodical strain rates and cycling patterns generate maximal osteogenic response in avian bones. In one of those papers, entitled "Regulation of Bone Formation by Applied Dynamic Loads," The Journal of Bone and Joint Surgery, 66-A(3): 397–492 (March 1984), an experiment demonstrated that cyclically loading the bones at 0.5 Hz caused bone formation, although repetition of more than 36 cycles did not seem to increase bone formation. The paper also suggested that an abnormal strain distribution caused an increase in bone mass. In a later paper by Rubin et al. entitled "Regulation of Bone Mass by Mechanical Strain Magnitude," Calcif. Tissue Int. 37:411–417 (1985), Rubin and Lanyon also showed a graded dose response subjected to 100 load cycles at 1 Hz, and showed a graded dose response relationship between peak strain and change in bone tissue mass.

These techniques of treating bone disorders with repetitive forces, however, did not preload the bone before applying the repetitive force.

U.S. Pat. No. 5,046,484 issued to Bassett et al. describes a clinically effective method and device for applying repetitive force to a patient who stands on a platform and is lifted and dropped according to parameters determined from various patient and treatment information. This method, however, requires a patient to be physically lifted and dropped, which causes balance problems and discomfort to some patients. Also, the method does not adapt easily to other bones. Furthermore, since the frequency component of the impact is derived from the equation for force, F=ma, as "m" mass increases, "a" acceleration must decrease to maintain "F" force within a practical range. Thus, individuals with large body mass cannot achieve appropriate frequency contents in their impacts because low velocity impacts. Since the individuals cannot be raised too high, impacts with higher frequency content are not achieved.

Therefore, it is an object of the present invention to devise an improved treatment for osteoporosis in humans which is both safe and effective and which does not require lifting and dropping a patient.

It is a further object of the present invention to preload the skeletal structure before applying a repetitive force.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, the method an apparatus of this invention preload the bone in a selected direction and then apply a series of impulses to the patient in the same direction. The patient can also be maintained in a static position, especially if gravity provides the preloading.

More specifically, a method of treating a bone in a patient according to this invention comprises the steps of maintaining the patient in a static position, preloading the bone in a first direction, and applying to the bone in the first direction a series of impulses. The first direction is determined according to the patient's skeletal tissue, and the characteristics of the series of impulses are determined according to the patient's skeletal tissue such that the impulses deliver to the bone a prescribed impact load at a prescribed impact rate. The prescribed impact load and prescribed rate are chosen to generate electrical signals in the patient's bone such that the majority of energy of the electrical signals lies between 0.1 Hz and 1 kHz, and the peak amplitude values of the electrical signals lie between 15 and 30 Hz.

Preloading can be provided through compression of the bone.

Both the foregoing general description and the following detailed description are exemplary and explanatory and are intended to provide further explanation of the invention as claimed.

BRIEF DESCRIPTION OF THE DRAWINGS

The accompanying drawings which are incorporated in and constitute a part of the specification, illustrate an embodiment of the invention and together with the general description given above plus the detailed discussion which follows serve to explain the principles of the invention.

DESCRIPTION OF PREFERRED EMBODIMENTS

Reference will now be made in detail to embodiments of the invention illustrated in the accompanying drawings.

Figure 1:
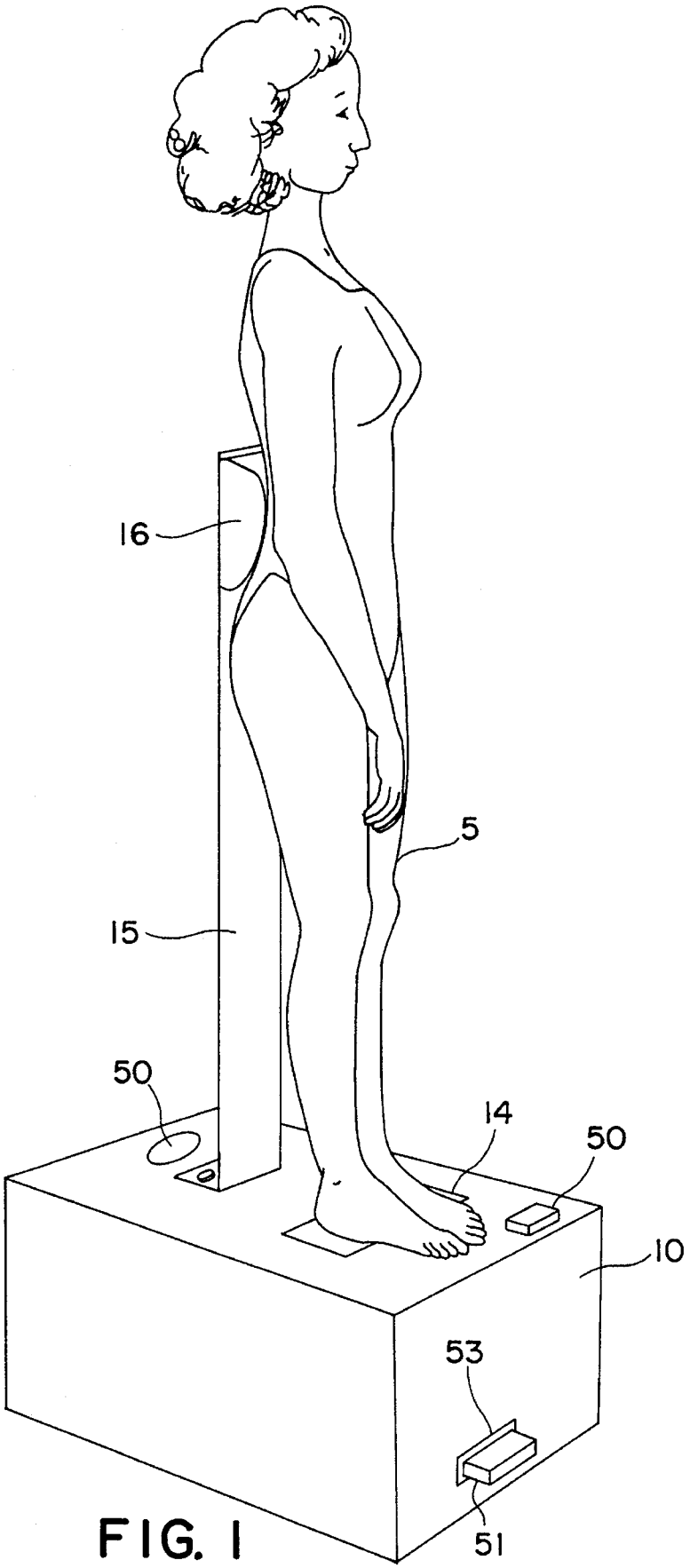
FIG. 1 is a drawing of a patient on a device in accordance with the prescribed invention.

FIG. 1 shows a patient 5 on a platform 10 containing a mechanism for generating an impact. A back rest 15 with a pad 16 stabilizes the patient and helps the patient assume an erect posture which will maximize transmission of the impulse from the heels up through the legs and spine. The preferred posture includes locked knees combined with a forwardly thrusted pelvis, a slightly arched back, and thrown-back shoulders.

Back rest 15 is vertically adjustable. The preferred height for pad 16 is in the small of patient 5's back. The horizontal displacement of pad 16 should be set to allow patients to lean backwards slightly during treatment.

The device of this invention functions efficiently by ensuring that the bone under treatment is subject to a preload. If the femoral neck and spine are the bones being treated, the patient is kept upright so that gravity produces loads of 500–1000 microstrains in these structures before impact. The impact loads are additive to the preload which greatly increases their efficiency.

Figure 2:
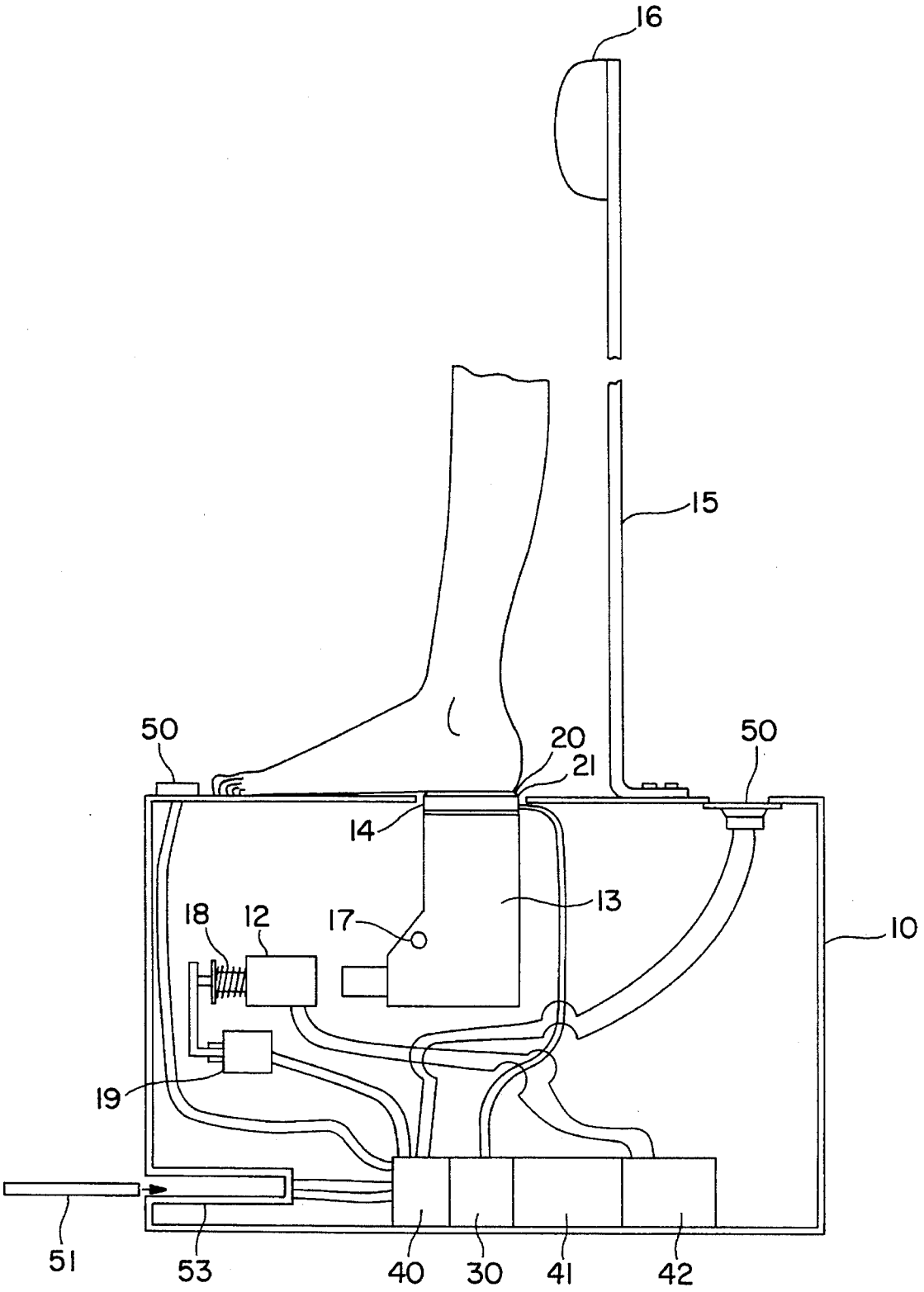
FIG. 2 is a cutaway side elevation of the platform of FIG. 1.

After ensuring that the amount of preload is proper, patient 5's heels are placed on platform 10 above impulse translator 14. Alternatively, dual impulse translators may be used to apply differing treatments to the left and right legs. Platform 10 and its components are shown in greater detail in FIG. 2. As shown in FIG. 2, solenoid 12 and translator 14 provide the selected impact. Solenoid 12 is alternately energized and de-energized to move against retraction spring 18 and strike a bellcrank 13. This striking causes bellcrank 13 to rotate about pivot 17 to provide a vertical force to impulse translator 14. Any appropriate device which can repeatedly strike impulse translator 14 can be used to generate impacts. Dual impact generators and impact translators may be provided so as to allow differing treatment of the left and right legs. Possible devices include solenoids, linear actuators, air and hydraulic cylinders, high rise motor driven cams and torsion springs which are wound by similar engines. To facilitate their packaging, levers and bellcranks may be used to modify their force and stroke characteristics or to change the direction of their stroke.

When struck, impulse translator 14 then imparts the suitable impulse to patient 5's heels. Impulse translator 14 is a passive device which functions to modify impact energy so as to insure the resulting skeletal impulse load and load rate generate electrical signals in the patient's skeletal tissue such that the majority of generated energy lies between 0.1 Hz and 1 kHz with peak energy centered at approximately 15–30 Hz. The impact generator and impact translator overcome the limitations of patients with large body mass in the prior art because the patient is not lifted and dropped. Thus, the previous limitations imposed by F=ma, whereby patients with a large mass cannot be lifted too high are not present. In the present invention the velocity and forces developed by the solenoid 12 can be controlled with a servo-positioned stop 19 to limit its excursion. The field strength and dwell-time of the solenoid 12 can also be changed to affect the frequency content. Additionally, cross-sectional and material properties of the translator 14 can play a role in determining high frequency responses in the impact. A more compliant translator will lower the frequency content of the impulse and a thicker, stiffer member will produce a higher frequency response. These frequencies have been shown to be more efficient in promoting osteogenesis and are chosen so as to reduce the amplitude of the impulse which must be delivered.

It is important to ensure that the device delivers the impulses in the proper direction to the bone. This direction, or vector, should be the same as the preload, or independent compressive load, applied to the bone. By choosing the proper vector of the preload, which can be accomplished by proper placement of the feet, and the proper amount of impulse loading, a physician can ensure that the treatment will add bone where it makes the greatest mechanical contribution. Vectoring of the preloading may be accomplished though modification of the patient stance. The purpose centers on altering stress distribution in the inferior medial femoral neck. These changes will modify the site-specific bone forming and resorbing responses on this anatomical position to gain the widest distribution and mechanical. advantage of the increasing bone mass.

As FIG. 2 shows, impulse translator 14 preferably includes a sensor 20 to measure impulse load and a sensor 21 to measure impulse rate. These measurements are transmitted to an A-to-D converter 30 which places the measurements in digital form for microprocessor 40. Many commonly available sensing devices can be used to sense the impulse load and impulse rate. Load cells, strain gauges, piezoelectric devices, and accelerometers are just a few possible sensing devices.

Microprocessor 40 receives such signals to ensure that patient 5 is receiving the proper treatment. Proper treatment is defined in terms of certain treatment parameters, such as the amount of preload to apply to the bone under treatment, the vectoring (i.e., angle) of the preload, the rate of impact, and the duration of treatment. Patient 5's physician determines values for treatment parameters based upon an examination of the anatomical and structural characteristics of the patient's skeletal tissue, as well as upon factors such as the patient's weight and bone mineral density. The patient's skeletal characteristics may be determined by common methods such as dual energy X-ray absorptiometry examination.

The physician may also consider the bone under treatment in determining values for treatment parameters. For example, when treating a femur, the femoral neck length, cross-sectional moment of inertia and its angle to the vertical are important factors for determining the vector of the preload and treatment. The strength of the femur depends primarily on proper anatomical distribution of bone tissue, particularly in the femoral neck which must carry a cantilevered load. Ample basic data now exists from the work of McLeod and Rubin to show very precise spatial distributions.

Microprocessor 40 can monitor the treatment delivered to patient 5 by comparing the measured impulse load from sensor 20 and the measured impulse rate from sensor 21, with the prescribed impact load and prescribed impact rate, respectively, stored in memory unit 41. Microprocessor 40 can then modify the operation of solenoid 12 to match the prescribed impact load. Preferably, microprocessor 40 performs such modifications by sending commands to reduce any differences between measured and prescribed loads and the measured and prescribed rates.

The results of microprocessor 40's comparison may also be used to generate audible and visual information to the patient via display 50. This is especially important when, as described below, patient 5 is responsible for reading the impact load and rate. Display 50 gives the patient feedback to ensure that the proper impulse is being provided. Preferably, one display indicates the treatment is proper, another indicates that the treatment values are too low, and another indicates the values are too high.

Patient data read into memory 41 from patient data module 51 can include duration which the microprocessor 40 uses to determine the number of impulses for a complete treatment session. After the required number of impacts, microprocessor 40 would stop solenoid 12. If duration is not provided, the treatment must be stopped manually, such as by a switch (not shown).

In the preferred embodiment, once a treatment session is over, microprocessor 40 places data it has collected from the treatment onto patient data module 51. Such data preferably includes the measured impulse loads and impulse rates.

Figure 3A:
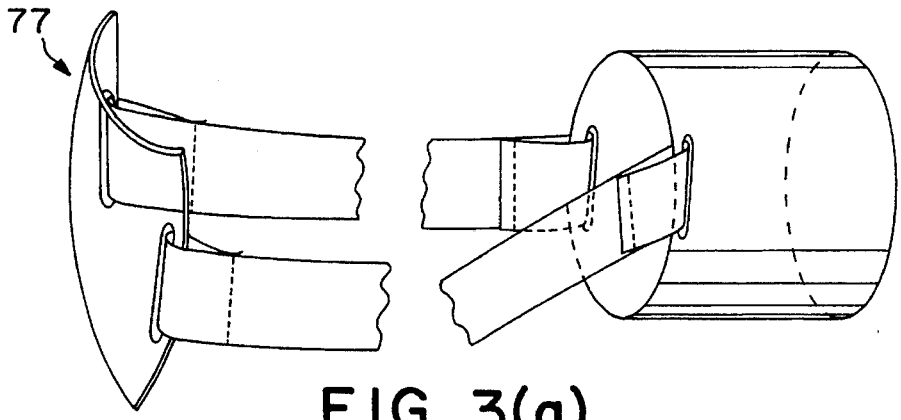
FIGS. 3(*a*) and 3(*b*) are views of two devices for providing mechanical preloading of the bone.
Figure 3B:
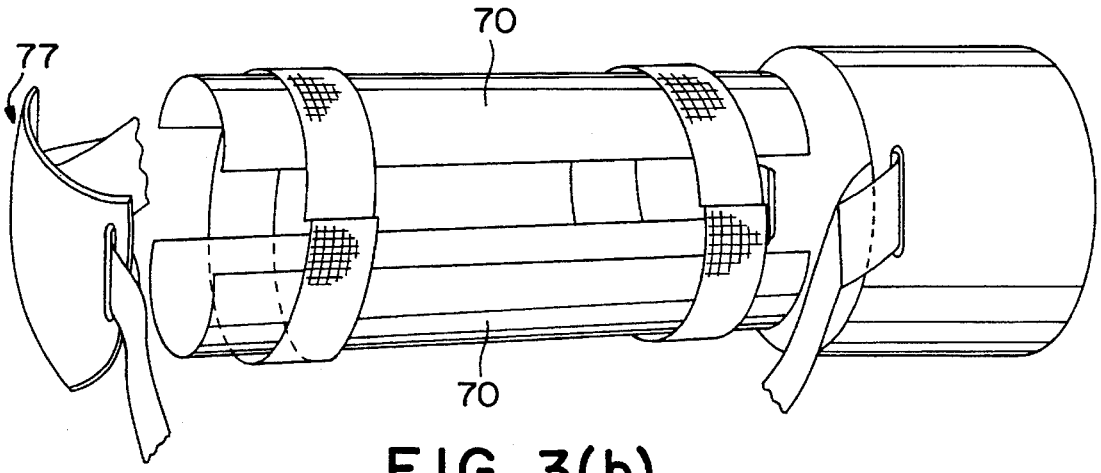
Figure 4:
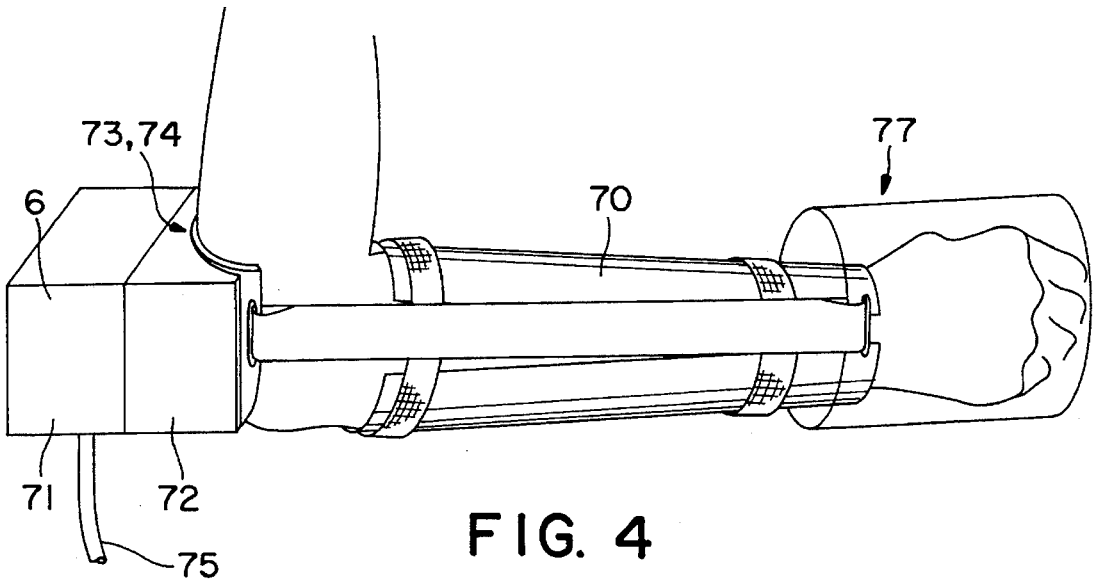
FIG. 4 shows mechanical compression of a forearm and an impact generator according to an embodiment of the invention.

Another embodiment of this invention involves application of the principle of impact stimulation of osteogenesis to skeletal members other than the legs and spine. The example chosen is the forearm as illustrated in FIGS. 3(*a*), 3(*b*), and 4. The device 70, as illustrated in FIG. 3(*b*), stabilizes the wrist. A device 77, as illustrated in FIG. 3(*a*), preloads the forearm by applying a compressive load to the fist and elbow and attaches to impact generator 71 and impulse translator 72. Impulse translator 72 contains sensor 73 for measuring the impulse load and sensor 74 for measuring the impulse rate. The impact generator 71, impulse load sensor 73 and impulse rate sensor 74 measuring means are connected to electronics similar to those in platform 10 of FIGS. 1 and 2 via cable 75.

The operation of the device in FIGS. 3(*a*), 3(*b*), and 4 is similar to the sequence described earlier. Impact generator 71 repeatedly delivers an impact to impulse translator 72 which in turn delivers an impulse to the skeletal tissue through the elbow. The impulses are measured by the impulse load sensor 73 and impulse rate sensor 74. These signals are transmitted via cable 75 to microprocessor 40 which compares the measurements with the prescribed values contained in memory 41. Based on those comparisons, microcomputer 40 controls the impact level provided by the impact generator 71 by controlling solenoid driver 42. Display 50 can also provide treatment information to patient 5.

As an alternative, A-to-D convertor 30, microprocessor 40, memory 41, solenoid driver 42, display 50, and patient data module receptacle 53 could be located outside platform 10. This arrangement would be well suited to treatment of different bones—that is, a control system in an enclosure which would be cable connected to an array of different impact-impulse devices designed to treat various bones in the skeletal structure. In this case, platform 10 would consist only of solenoid 12, bellcrank 13, impulse translator 14, back rest 15, pad 16, stop 19, and plot 17. All the other elements would be located in the control enclosure.

FIGS. 3(*a*), 3(*b*), and 4 show, different preload and impactive devices to fit various parts of the body. Preloading can be provided by gravity, mechanical compression devices to simulate gravity, or isometric muscle activity. For example, preloading the legs and spine may be accomplished by having the patient stand in an erect posture on a platform which provides impact through the impulse translator to the os calci as shown in FIG. 1.

In FIG. 3, there is no gravitational or muscle contraction preload in this case, therefore a mechanical preloading is administered to the radius, ulna, carpals and metacarpals. Using a compressive preload between the fist and the elbow, the wrist is stabilized with a splint. The impulse translation device is fitted against the elbow.

Though the impact generator thus far described is an active device which generates the impact energy, it would be apparent to those skilled in the art that the impact energy can also by provided by the patient. In the application described by FIG. 3, the impulse translation device would be coupled to the elbow as a part of the preload-splint device and the patient could provide the impact by striking the impulse translator against a solid surface. This application could be reversed so the impact impulse is provided to the fist rather than the elbow.

Figure 5:
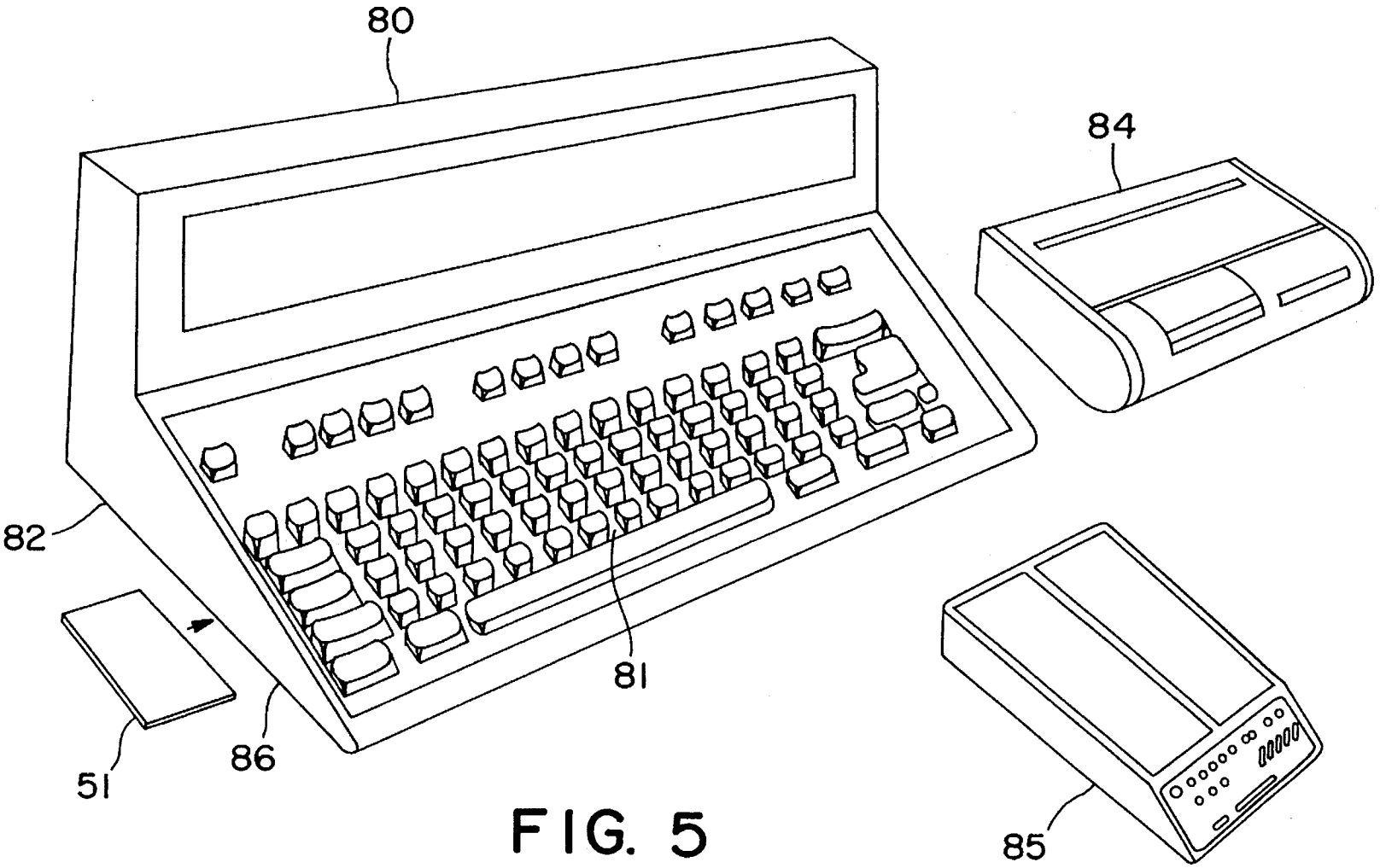
FIG. 5 shows a microcomputer and associated hardware for updating and reading information on a patient data module.

In the preferred embodiment, the physician would have a computer system to record the treatment parameters and to read the measured treatment data. FIG. 5 shows such a computer system. The doctor's computer system 80 which includes keyboard 81, microprocessor 82, printer 84, modem 85, and patient data module receptacle/writer 86. When a physician determines the proper treatment duration, impact load, and impact rate, he causes receptacle/writer 86 to record these values on patient data module 51.

After the patient has undergone treatment and the treatment data has been recorded on patient data module 51, the patient would give module 51 to the physician. The physician would then place data module 51 into receptacle/writer 86 and, microprocessor 82, prints the treatment data using printer 84 or analyzes that data. The treatment data allows the physician to be aware of the patient's compliance as well as the exact dosage received. This kind of monitoring is extremely important in practice. Past exercise systems have had no means to monitor what was being done and relay this information back to the physician, short of direct monitoring by an attendant.

Modem 85 provides transmission of patient data to a remote site on a real-time or delayed transmission basis.

Additional advantages and modifications will readily occur to those skilled in the art from reading the description of the preferred implementations and from understanding the concepts of this invention. The invention in its broader aspects is not limited to the specific details, representative apparatus, and illustrative examples shown and described above. Departures may be made from such details without departing from the spirit or scope of the general inventive concept as defined by the appended claims and their equivalents.

What is claimed is:

1. A method of treating a bone in a patient comprising the steps of:

maintaining the patient in a static and stationary position;

preloading the bone in a first direction determined according to the patient's skeletal tissue; and applying to the bone in a second direction opposite to the first direction a series of impulses determined according to the patient's skeletal tissue such that the series of impulses delivers to the bone a prescribed impact load at a prescribed impact rate, the prescribed impact load and prescribed rate being chosen to generate electrical signals in the bone such that a majority of energy of the electrical signals lies between 0.1 Hz and 1 kHz, and the peak amplitude values of the electrical signals lie between 15 and 30 Hz.

2. The method of claim 1 wherein the applying step includes the substep of applying the impulses automatically for a prescribed duration.

3. The method of claim 1 further including the steps of measuring an impulse load applied to the patient;

comparing the measured impulse load to the prescribed impact load; and adjusting the impulse load applied to the patient to minimize the difference between the measured impulse load and the prescribed impact load.

4. The method of claim 3, further including the step of:

providing sensory feedback to the patient corresponding to the difference between the measured impulse load and the prescribed impact load.

5. The method of claim 3 further including the step of:

recording the measured impulse load.

6. The method of claim 1 further including the steps of measuring an impulse rate of the impulses applied to the patient;

comparing the measured impulse rate to the prescribed impact rate; and adjusting the rate of the impulses applied to the patient to minimize the difference between the measured impact rate and the prescribed impact rate.

7. The method of claim 6, further including the step of:

providing sensory feedback to the patient corresponding to the difference between the measured impulse rate and the prescribed impact rate.

8. The method of claim 6 including the step of recording the measured impulse rate.

9. The method of claim 1, wherein the step of preloading the bone includes the step of applying a mechanical compression to the bone.

10. The method of claim 1 wherein the step of preloading includes the substep of preloading a second bone in a third direction determined according to the patient's skeletal tissue; and the applying step includes the substep of applying to the second bone in a fourth direction opposite to the third direction a series of impulses determined according to the patient's skeletal tissue such that the series of impulses delivers to the second bone a prescribed impact load at a prescribed impact rate, the prescribed impact load and prescribed rate being chosen to generate electrical signals in the second bone in such that a majority of energy of the electrical signals lies between 0.1 Hz and 1 kHz, and the peak amplitude values of the electrical signals lie between 15 and 30 Hz.

11. A device to treat a bone of a patient comprising:

means for maintaining the patient in a static and stationary position;

means for preloading the bone in a first direction determined according to the patient's skeletal tissue; and impulse means for applying to the bone in a second direction opposite to the first direction a series of impulses determined according to the patient's skeletal tissues such that the series of impulses delivers a prescribed impact load at a prescribed impact rate, the prescribed impact load and prescribed impact rate being chosen to generate electrical signals in the patient's skeletal tissue such that a majority of energy of the electrical signals lies between 0.1 Hz and 1 kHz, with peak amplitude values lying between 15 and 30 Hz.

12. The device of claim 11 further including measuring means for measuring an impulse load applied to the patient;

comparison means, coupled to the measuring means, for comparing the measured impulse load to the prescribed impact load; and feedback means, coupled to the comparison means, for adjusting the impulse load applied to the patient to minimize the difference between the measured impulse load and the prescribed impact load.

13. The device of claim 12, further including means, coupled to the feedback means, for providing sensory feedback to the patient indicating the difference between the measured impulse load and the prescribed impact load.

14. The device of claim 12, further including means, coupled to the measuring means, for recording the measured impulse load.

15. The device of claim 11 further including second measuring means for measuring an impulse rate of the impulses applied to the patient;

comparison means, coupled to the second measuring means, for comparing the measured impulse rate to the prescribed impact rate; and feedback means, coupled to the comparison means, for adjusting the rate of the impulses applied to the patient to minimize the difference between the measured impulse rate and the prescribed impact rate.

16. The device of claim 15, further including means, coupled to the feedback means, for providing sensory feedback to the patient indicating the difference between the measured impact rate and the prescribed impact rate.

17. The device of claim 15, further including means, connected to the second measuring means, for recording the measured impulse rate.

18. The device of claim 11 wherein the means for preloading includes means, coupled to the impulse means, for mechanically compressing the bone.

19. The device of claim 11 wherein the means for preloading includes means for preloading a second bone in a third direction determined according to the patient's skeletal tissue; and the impulse means includes means for applying to the second bone in a fourth direction opposite to the third direction a series of impulses determined according to the patient's skeletal tissues such that the series of impulses delivers a prescribed impact load at a prescribed impact rate, the prescribed impact load and prescribed impact rate being chosen to generate electrical signals in the patient's skeletal tissue such that a majority of energy of the electrical signals lies between 0.1 Hz and 1 kHz, with peak amplitude values lying between 15 and 30 Hz.

20. A method of treating a bone in a patient comprising the steps of:

preloading the bone in a first direction, determined according to the patient's skeletal tissue, by applying mechanical compression to the bone; and applying to the bone in a second direction opposite to the first direction a series of impulses determined according to the patient's skeletal tissue such that the impulses deliver to the bone a prescribed impact load at a prescribed impact rate, the prescribed impact load and prescribed rate being chosen to generate electrical signals in the patient's bone such that a majority of energy of the electrical signals lies between 0.1 Hz and 1 kHz, and the peak amplitude values of the electrical signals lie between 15 and 30 Hz.

21. A device to treat a bone of a patient comprising:

means for mechanically compressing the bone in a first direction determined according to the patient's skeletal tissue; and impulse means for applying to the bone in a second direction opposite to the first direction a series of impulses determined according to the patient's skeletal tissues such that the impulses deliver a prescribed impact load at a prescribed impact rate, the prescribed impact load and prescribed impact rate being chosen to generate electrical signals in the patient's skeletal tissue such that a majority of energy of the electrical signals lies between 0.1 Hz and 1 kHz, with peak amplitude values lying between 15 and 30 Hz.

* * * * *